US006510967B1

(12) United States Patent
DeSimone

(10) Patent No.: US 6,510,967 B1
(45) Date of Patent: Jan. 28, 2003

(54) ERGONOMIC AEROSOL DISPENSING SYSTEM

(75) Inventor: Ronald F. DeSimone, Broadview, IL (US)

(73) Assignee: Chase Products Company, Maywood, IL (US)

( * ) Notice: Subject to any disclaimer, the term of this patent is extended or adjusted under 35 U.S.C. 154(b) by 76 days.

(21) Appl. No.: 09/343,015

(22) Filed: Jun. 29, 1999

(51) Int. Cl.[7] ..... B65D 83/52
(52) U.S. Cl. ..... 222/402.1
(58) Field of Search ..... 222/402.1, 402.13, 222/394, 383, 635; 220/755, 672; 215/382, 384; D9/502, 530, 538

(56) References Cited

U.S. PATENT DOCUMENTS

| | | | | | |
|---|---|---|---|---|---|
| 291,004 | A | * | 12/1883 | Rosensteel | 222/672 |
| 1,807,912 | A | * | 6/1931 | Hansson | 222/672 |
| 2,339,763 | A | | 1/1944 | Calleson et al. | 113/120 |
| 2,950,839 | A | | 8/1960 | Hahn | 220/64 |
| D200,177 | S | * | 1/1965 | Bijvoet et al. | D9/530 |
| 3,272,383 | A | | 9/1966 | Harvey | 220/66 |
| 3,279,640 | A | | 10/1966 | Dodson | 220/5 |
| D208,504 | S | * | 9/1967 | Trombley | D9/530 |
| D209,931 | S | * | 1/1968 | Sterges | D9/530 |
| D218,018 | S | * | 7/1970 | Lattraye et al. | D9/530 |
| 3,995,572 | A | * | 12/1976 | Saunders | D9/502 |
| 4,313,545 | A | | 2/1982 | Maeda | 220/1 |
| 4,775,071 | A | | 10/1988 | Giggard | 220/67 |
| 5,172,836 | A | | 12/1992 | Warner | 222/383 |
| D339,514 | S | | 9/1993 | Hirst et al. | D9/300 |
| D340,413 | S | * | 10/1993 | Emig | D9/502 |
| D348,837 | S | * | 7/1994 | Feen | D9/502 |
| 5,339,977 | A | * | 8/1994 | Schormair et al. | 222/672 X |
| 5,353,962 | A | | 10/1994 | Scholz et al. | 222/95 |
| 5,397,021 | A | | 3/1995 | Usui | 220/667 |
| D357,177 | S | | 4/1995 | Labus | D9/300 |
| D375,684 | S | | 11/1996 | Hope | D9/502 |
| D378,492 | S | | 3/1997 | Salle | D9/300 |
| D396,640 | S | | 8/1998 | Conrad et al. | D9/502 |
| 5,797,522 | A | | 8/1998 | Evans et al. | 222/646.4 |
| 5,862,929 | A | * | 1/1999 | Takeuchi et al. | 222/384 X |
| 5,878,906 | A | | 3/1999 | Bolton et al. | 220/309 |
| D409,303 | S | | 5/1999 | Oepping | D24/108 |
| D409,492 | S | | 5/1999 | Kato | D9/502 |
| D410,821 | S | | 6/1999 | Huang | D7/608 |
| 5,918,780 | A | * | 7/1999 | Tanaka | 222/402.13 |
| D412,849 | S | | 8/1999 | Fuquen et al. | D9/542 |
| D414,700 | S | * | 10/1999 | Zogg | D9/502 |
| 6,065,624 | A | | 5/2000 | Steinke | 215/383 |

* cited by examiner

*Primary Examiner*—Hyung-Sub Sough
*Assistant Examiner*—Thach H. Bui
(74) *Attorney, Agent, or Firm*—Jenner & Block, LLC

(57) ABSTRACT

An aerosol dispensing system includes a metal cylindrical can having a plurality of wide and narrow recesses in an upper undulating portion and a smooth walled lower portion. A plastic spray dome snap-fits over the top of the metal can and includes a trigger actuator movable against a valve assembly for releasing concentrate and propellant maintained under pressure within the can. The annular recesses are ergonomically located to fit the thumb and fingers of the hand when the index finger is located on the actuator. The annular recesses are preferably recessed into the otherwise straight-walled can but can take a variety of other shapes.

19 Claims, 3 Drawing Sheets

ERGONOMIC AEROSOL DISPENSING SYSTEM

FIELD OF THE INVENTION

This invention relates to an aerosol dispensing system having a pressurized container which stores propellant and concentrate, and more particularly to an ergonomic aerosol dispenser for minimizing repetitive task injuries and for improved handling capabilities.

BACKGROUND OF THE INVENTION

Aerosol dispensing systems typically consist of a cylindrical metal container having straight walls of sufficient strength and rigidity to store a concentrate and propellant which are under pressure. A plastic spray dome covers and activates a valve to initiate the flow of concentrate and propellant which mix and disburse in an aerosol spray. Such aerosol dispensers can conveniently and safely disburse a variety of chemical compositions including paint, insecticide, and cleaning compounds. Some aerosol dispensers are used for industrial applications such as cleaning chemicals, in which the users are repetitively using the aerosol dispenser throughout the day. Extended periods of use of ordinary aerosol dispensers can create symptoms similar to repetitive task injuries. Furthermore, aerosol dispensers for both industrial and consumer use can be difficult to aim accurately and utilize in a convenient manner, particularly when the user is wearing gloves.

Plastic molded containers are known for beverage and other uses and which utilize a wide variety of shaped containers having depressions, ribs, and gripping surfaces for improved grip and retention by the human hand. Furthermore, there are a variety of cylindrical metal containers for food products which are vacuumed packed and which have ribs or depressions for strength and which assist in gripping and lifting the container, such as metal coffee cans. Such technology has not been applied to nor is it readily adaptable to the requirements of pressurized aerosol dispensers.

Typical pressurized aerosol containers consist of a steel or metal can of smooth cylindrical shape. Separate metal bottom and top walls, and a valve assembly, create a sealed and pressurized container capable of withstanding the initial pressure and repeated pressure fluctuations while dispensing of the aerosol contents. For cost and strength considerations, the typical aerosol container is formed of a rectangular piece of thin steel which is rolled and welded along an elongated seam. Such containers are more difficult to shape than plastic blow molded parts. Additional considerations beyond strength and durability include the ability to lithograph or print product information and advertising on substantially the entire can.

Other aerosol containers are known including aluminum cans which are more adaptable to some shaping of the top and bottom surfaces. Also known are glass aerosol bottles, and plastic aerosol containers which can be fabricated and shaped, particularly with a variety of molded neck shapes for gripping and aesthetic considerations. However, cost and content considerations, including compatibility problems with the chemical compositions inside the container, reduce the desirability of aluminum and non-metal aerosol containers. Furthermore, aerosol dispensers in general have not been recognized as needing ergonomic design as would reduce repetitive stress injury.

SUMMARY OF THE INVENTION

The present invention relates to aerosol dispensing systems which store concentrate and propellant under pressure, and which are ergonomically designed so as to overcome the disadvantages of conventional aerosol dispensers. The invention has particular utility with steel or metal aerosol cans which store and repeatedly release content under pressure.

More particularly, the present invention includes a plurality of annular recesses formed in a cylindrical aerosol metal can and which are located near the valve assembly. The location and spacing are ergonomically selected such that a user may hold the dispenser and repeatedly activate the release with an index finger of the hand with reduced repetitive stress. Furthermore, the ergonomic recesses improve the ability to grip and comfortably hold the aerosol can in use. This is particularly desirable for aerosol dispensers used in industrial applications, as well as industrial and consumer applications where the contents are heavy and/or the can may slip in use, and/or in which a gloved hand reduces tactile feedback.

The advantages of the invention are adaptable to pressurized aerosol dispensing systems without adversely impacting the printing area for the can. The dispensing system permits essentially the entire cylindrical container to contain printing and graphic information and creates a commercially attractive aerosol dispensing system. The system is particularly adaptable to steel cans or other metal containers which are rolled and welded along a longitudinal seam and are mated with plastic spray dome.

One object of the present invention is to provide a pressurized aerosol dispensing system which incorporates ergonomic shapes to reduce the risk of repetitive task injury and to provide a surer grip which can compensate for reduced sensory input.

Another object is to provide aerosol dispensers particularly useful for industrial applications and consumer applications involving harsh chemicals in which users may wear plastic gloves. The use of a gloved hand reduces the gripping ability on the aerosol container due to reduced sensory input to the user. The invention improves the ability to grip a metal aerosol can by use of a gloved hand.

Other objects and advantages of the present invention will be apparent from the following description with reference to the attached drawings.

DESCRIPTION OF THE PREFERRED EMBODIMENTS

Figure 1:
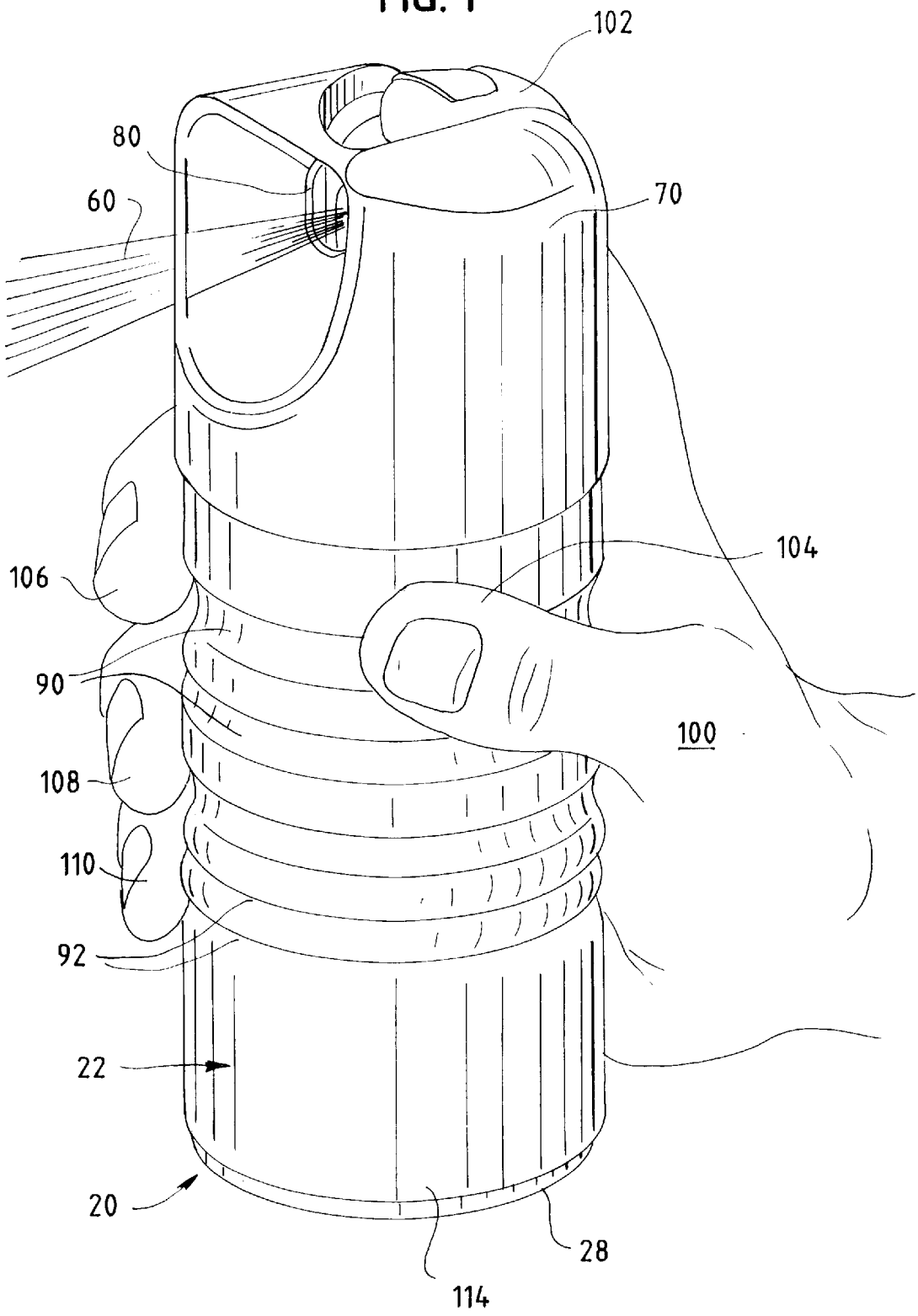
FIG. 1 shows a perspective view of a first embodiment of an ergonomic aerosol dispensing system being held by a user.
Figure 2:
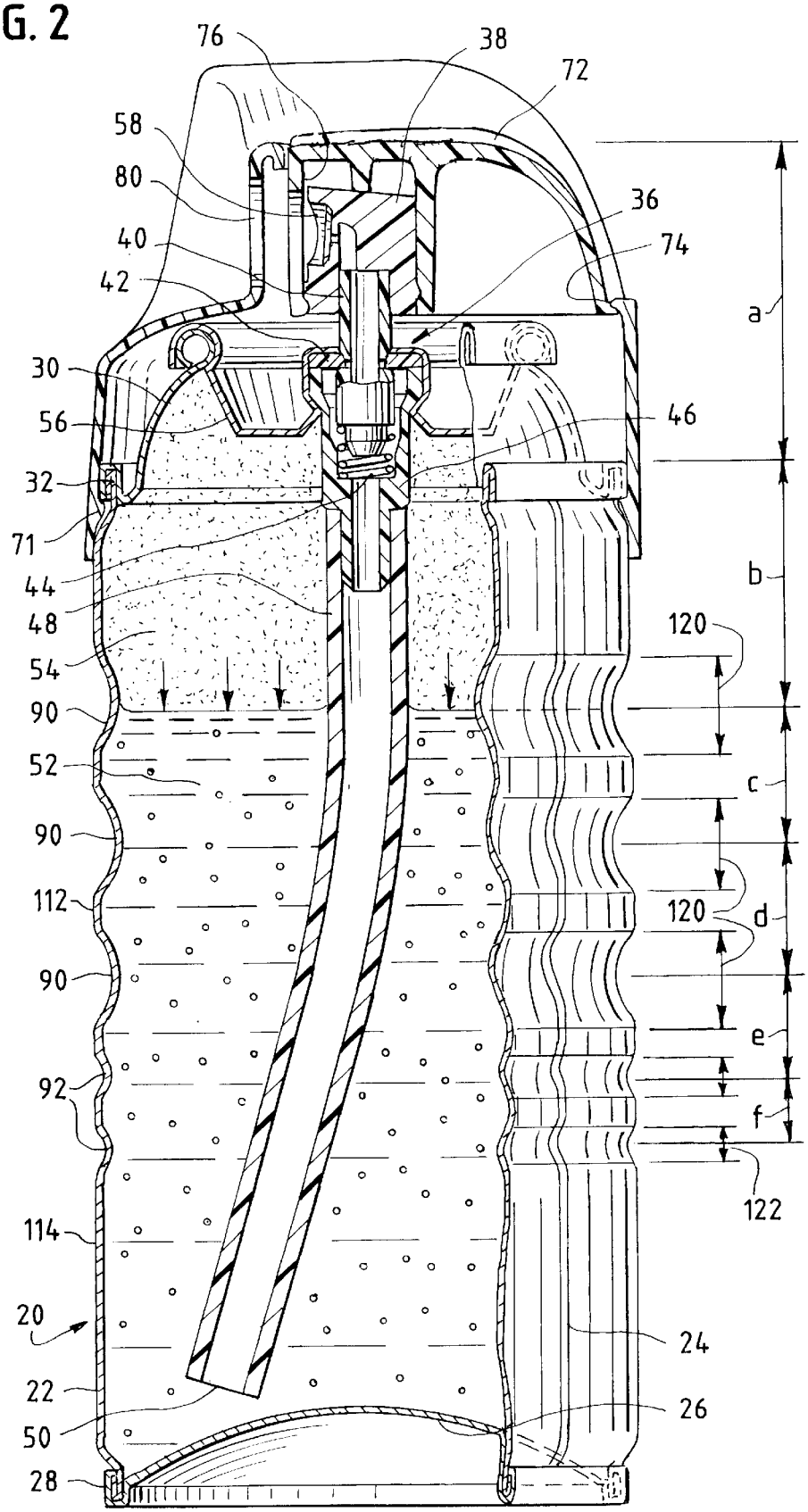
FIG. 2 shows a side view, partly in section, of the aerosol dispensing system of FIG. 1.

FIGS. 1 and 2 illustrate a first embodiment of a novel ergonomic aerosol dispensing system 20. The aerosol dispenser consist of a metal container or can 22 formed of a thin rectangular steel sheet which is rolled into a cylindrical shape and is welded along an elongated seam 24, see FIG. 2. Essentially the entire external surface of the resulting metal cylinder (other than the elongated welded seam 24)

can be lithographic or printed with product and advertising content before being welded along seam 24. The open top and open bottom are both of reduced diameter, i.e. are known as a "necked-in" can. A concave metal can base 26 is crimped at its edge to form a bottom bead 28 or curl which forms a pressure seal. A metal top dome 30 is crimped at its edge to form a top bead 32 or curl to form a pressure seal. While the top bead 32 and bottom bead 28 are indented slightly from the cylindrical wall to produce a "necked-in" can, a conventional "straight-sided" can can be formed if desired.

A valve assembly 36 is crimped to the top dome 30. The valve assembly 36 includes a valve button 38 which movably rests on a valve stem 40 which is fixedly secured within a housing 46. A gasket 42 is located beneath the valve stem, and a cylindrical spring 44 is tensioned upwardly against the gasket. At the bottom of the valve housing 46 is secured a hollow dip tube 48 which extends downwardly and has a bottom opening 50 near the can base 26.

The aerosol dispenser 20 is capable of holding a mixture of concentrate and liquid propellant 52 which is under pressure. The concentrate can be paint, insecticide, cleaning chemicals or the like. Vaporized propellant 54 is released into the top space above the liquid propellant and concentrate 52, and creates downward pressure on the liquid propellant and concentrate 52.

The valve housing 46 is crimped to a metal carrier 56 which in turn is crimped to the top dome 30. The result is a sealed, pressurized container which retains the concentrate and liquid propellant until the valve assembly is activated for use. The gasket 42 prevents the flow of concentrate and liquid propellant by sealing the valve stem 40 at the orifice and the shoulder regions of the assembly.

When a user causes the button 38 to be depressed, the button moves downwardly against the tension of the spring 44. The gasket 42 flexes and exposes the orifice of the valve stem 40 to the interior of the dip tube 48. As a result, the concentrate and liquid propellant 52 is forced through the bottom opening 50 and upwardly through the hollow dip tube 48. The concentrate and liquid propellant is mixed in the valve assembly 36 and forced through interior passages 58 in the button 38 and are released as an aerosol spray 60, see FIG. 1.

A plastic spray dome 70, which can be of one piece or two piece construction and formed of polypropylene material, is snap fit to the top of the metal can 22. The dome 70 forms a cap or cover which remains on the dispenser during use. A series of ridges 71 around the bottom of the dome snap-fit over the necked-in beads 32 to retain the dome against the can 22. The dome 70 includes a trigger actuator 72 attached by a hinge 74 at its rear base to allow vertical movement of the trigger actuator. The trigger actuator 72 includes a bottom cup 76 which captures the button 38 and forces the button 38 downwardly as the trigger actuator 72 is depressed downwardly by the index finger or thumb of the user as seen in FIG. 1. This opens the valve assembly 36 so that the aerosol spray 60 escapes through a circular aperture 80 located in the spray dome 70.

While use of a spray dome 70 is generally preferred, the spray dome 70 can be eliminated and the user can directly depress the valve button 38 by the index finger or thumb. In such a system, a plastic cap (not illustrated) is snap-fit over the top bead 32 to protect the button 38 from accidental depression during storage. The cap is removed by the user before use of the dispenser. Either version of the aerosol dispenser can be utilized with the present invention.

The aerosol metal can 22 preferably has a wavy upper section having an undulating side wall, and a smooth lower section formed by a straight wall. The upper section includes a plurality of annular surfaces such as concave recesses near the valve 38 and/or the actuator 72 of the spray dome 70. In particular, a first series of wide annular concave recesses 90 are followed by a second plurality of narrow annular concave recesses 92. The annular recesses 90 and 92 preferably extend inwardly from the cylindrical plane of the smooth and straight-sided cylindrical wall of the lower section of the can 22. The plurality of recesses 90 and 92 are selected, as will be explained, to allow the aerosol dispenser 20 to be ergonomically held in the hand for both gripping and dispensing purposes. The width and depth of the wide annular recesses 90 are selected to conform to and mate with the human thumb and fingers for a comfortable grip when held as illustrated in FIG. 1. The narrow annular recesses 92 create a transition zone between the series of wide recesses 90 and the smooth bottom portion of the can. The transition zone 92 is aesthetically pleasing and in addition provide an additional gripping surface although not as deep or wide as the annular recesses 90.

The hollow dip tube 48 preferably extends downwardly past the wavy upper section and into the smooth lower section formed by the straight side wall 114. The opening 50 is near the bottom wall 26 so most of the concentrate will be disbursed in the form of the aerosol spray 60.

The aerosol dispensing system 20 as seen in FIG. 1 allows an index finger 102 of a human hand 100 to rest against the trigger actuator 72 (or against the valve button 38 in the event that a spray dome 70 is not utilized). When so located, a thumb 104 and another finger 106 are located within the topmost annular recess 90 to firmly grip the can. The remaining fingers 108 and 110 can rest within the second and third of the wide recesses 90, or alternatively, can extend somewhat further down to the transition recesses 92.

Between the plurality of recesses 90 and 92 are a series of ridges 112 which are coaxial with the smooth-walled bottom cylinder 114. The ridges correspond to the portions of the cylindrical can wall which were not pressed inwardly to create the series of concave annular depressions 90 and 92. The height of the can 22 will vary, and various heights are standard in the industry. The annular recesses 90 and 92 preferably encircle the entire can 22. This ensures that the aerosol dispenser can be gripped conveniently at any location, and does not have to oriented in a particular manner.

To form the can, a thin, flat rectangle of metal is formed. The material may be steel of about 0.00825 inches in thickness and can range from about 0.007 inches to about 0.009 inches in thickness. The exterior side of the metal rectangle strip can be lithographic or otherwise printed with product content and advertising. Then, the flat sheet is rolled or formed into a cylinder which abuts along the longitudinal seam 24, which is then welded closed. Next, a mold can be inserted into the hollow interior of the cylindrical can. The mold has annular recesses corresponding to the locations of the annular depressions 90 and 92, and external pressure is applied so as to deform the can wall to create the concave depressions 90, 92. The ridges 112 represent the original smooth can wall before being deformed, and are coaxial with the lower portion of the smooth wall 114.

Gloves may be used to protect the hands from the chemical contents of certain aerosol dispensers. However, the gloves effectively dampen the sensory perception loop, and while protecting the hand from paint or harsh chemicals, can reduce the human sensory perception below the level required to maintain an assured grip. The ergonomic recesses 90, 92 increase the gain to the human sensory loop. In addition, persons with sensory limitations, such as those with arthritis, nerve damage, or environmentally stressed tissue, will also benefit from a surer grip on the can.

The locations for the plurality of annular depressions 90 and 92 will be explained with reference to FIG. 2. A length "a" extends from a resting surface for the index finger (e.g., the upper surface of the trigger actuator 72) to the can top at the necked-in bead 32. A length "b" extends from the beaded top to the center line for the first or topmost annular wide recess 90. Lengths "c" and "d" extend to the center lines of the second and third wide recesses 90. A length "e" further extends to the center line of the first narrow recess 92 located in the transition zone. Finally, a length "f" extends from that location to the center line of the last narrow recess 92 before the smooth lower cylinder wall 114.

As an example, the lengths in inches for these locations for one exemplary embodiment are given in the following Table 1.

TABLE 1

| Ref | Length |
|---|---|
| a | 1.875 |
| b | 1.125 |
| c | 0.563 |
| d | 0.563 |
| e | 0.453 |
| f | 0.313 |

In this exemplary embodiment, the width 120 of each of the wide concave recesses 90 was approximately 0.375 inches. The widths 122 of each of the narrow recesses 92 was approximately 0.1875 inches.

The distance between the resting position of the index finger 102 on the actuator and the first wide recess 90 is important to properly fit an average human hand 100. This distance corresponds to the sum of the lengths "a" and "b," and generally should be on the order of 2.8125 to 2.875 inches. These dimensions were selected by measuring a variety of human hands to determine some "nominal" or typical dimensions for an adult hand. It will be appreciated, however, that the human hand varies and there is no specific set of dimensions which are ideal for all circumstances. The outer diameter of the aerosol can 22 is generally in the range of 2 to 3 inches.

In one exemplary embodiment, the can 22 for the Table 1 dimensions was a 211×604 can (using the industry standard in which the first digit represents whole inches and the last two digits represents 1/16 inch increments), i.e., a can having a diameter of 2 and 11/16 inches and a length from the top bead 32 to the bottom bead 28 of 6 and 4/16 inches. It will be appreciated that the length of the lower smooth section of the can may be any length as desired.

In general, the actuator will be on the order of 1.5 inches to 2.5 inches above the center of the topmost wide recess 90. In some embodiments, this length will correspond to the top of the trigger surface 72 of the spray dome. In other versions, this length will correspond to the top of the valve button 38 when no spray dome 70 is utilized.

Figure 3:
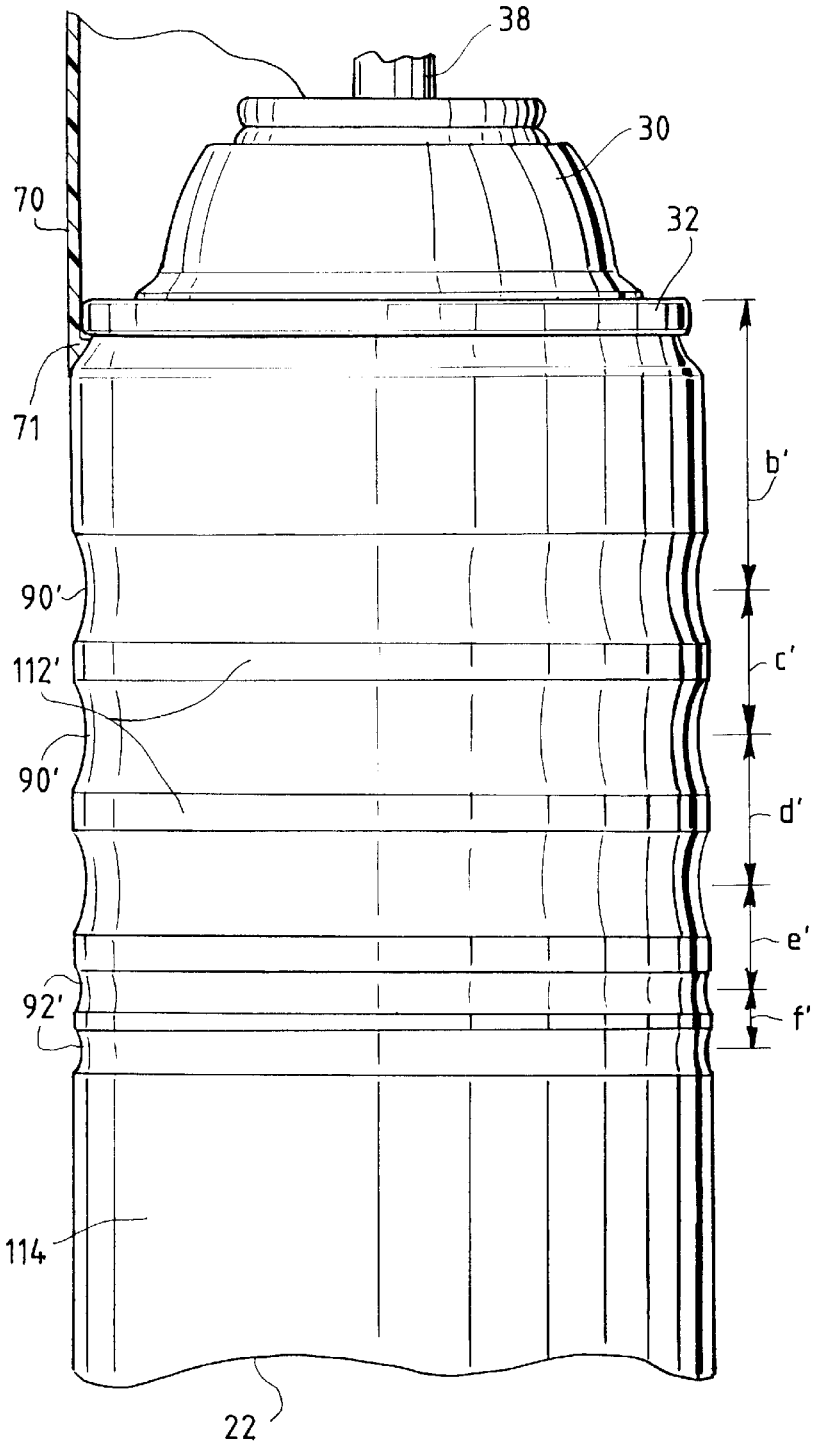
FIG. 3 is a partial side view of a second embodiment for the aerosol dispensing system.

Another embodiment of the ergonomic aerosol dispenser is seen in FIG. 3, in which like reference numerals and characters refer to like parts. The aerosol dispenser is of the same type as illustrated in FIG. 2, except that the undulating upper section consists of a first plurality of wide concave recesses 90' and a second plurality of narrow transition concave recesses 92' have somewhat different shapes and locations. In the FIG. 3 embodiment, the three wide recesses 90' are wider and deeper so that the fingers and thumb will better grip the recesses. Also, the ridges 112' between the annular recesses are not all of equal extent, and create a more pronounced series of annular recesses for the hand. By way of example, representative lengths in inches for the various dimensions shown in FIG. 3 are indicated in the following Table 2.

TABLE 2

| Ref | Length |
|---|---|
| a' | 1.8750 |
| b' | 1.3125 |
| c' | 0.6250 |
| d' | 0.6250 |
| e' | 0.4375 |
| f' | 0.2500 |

While certain preferred embodiments use at least three wide recesses for the fingers and two or more transition recesses of narrower shape, some of the advantages of the invention can be accomplished with other configurations.

Figure 4:
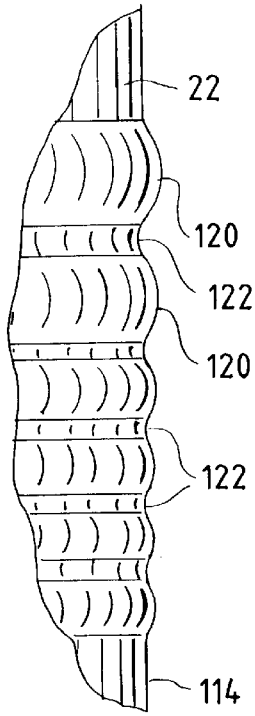
FIG. 4 is a partial side view of the aerosol can for a third embodiment of the aerosol dispensing system.

In FIG. 4, the metal can 22 has been shaped to have outward bulges or beads 120 which are convex and extend outwardly from the otherwise smooth lower cylinder wall 114. Between the beads 120 are a series of recesses 122 which are shallow, and may be coaxial with the smooth lower wall 114. Furthermore, it is not essential that the wide recesses all be of the same extent. It is desirable for the topmost recess to hold the thumb 104 and/or first finger 106 after the index finger, as illustrated in FIG. 1. The annular recesses extending towards the bottom of the can become progressively somewhat less essential, and can be formed of different shapes. A variety of configurations are possible provided that the strength and integrity of the pressurized aerosol can is maintained when considering the variations in pressure which will exist during use.

Figure 5:
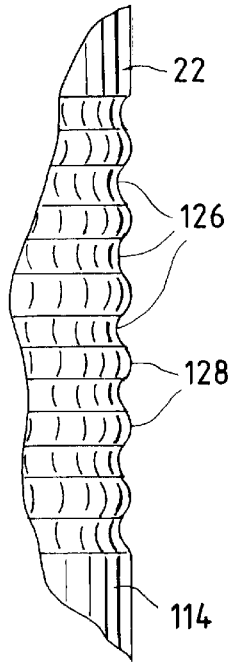
FIG. 5 is a partial side view of a fourth embodiment of the aerosol dispensing system.

FIG. 5 illustrate a still further embodiment in which a plurality of annular recesses 126 are generally of equal extent in the upper wavy section until reaching the lower smooth wall 114 of the can. In this embodiment, the transition ridges 128 are generally of equal length to the annular recesses 126. Thus, the recesses and ridges are generally uniform in extent. While this embodiment lacks the advantage of wide annular recesses sufficient to mate with the thumb and fingers, it nonetheless is an improvement over conventional metal aerosol cans and provides improved gripping ability. It also has improved slip resistance even for a gloved hand as compared with standard metal aerosol cans.

Further modifications and variations in the invention will be apparent to one of ordinary skill in the art.

What is claimed is:

1. An aerosol dispenser comprising:

an aerosol container having a cylindrical side wall, a bottom wall sealed to the side wall, and a top wall sealed to the side wall, a valve assembly located in the top wall and movable to release a mixture storable under pressure within the aerosol container, an actuator mechanism located above the valve assembly for receiving an index finger of a user's hand in order to activate the valve assembly to create an aerosol spray, and a plurality of annular surfaces in an upper portion of the cylindrical side wall and located to receive fingers and/or a thumb of the user's hand when the index finger is on the actuator mechanism in order to create an ergonomic grip for the user's hand.

2. The aerosol dispenser of claim 1 wherein the cylindrical side wall consists of an undulating upper portion including the plurality of annular surfaces and a smooth lower portion having a straight cylindrical wall.

3. The aerosol dispenser of claim 2 wherein one of the plurality of annular surfaces are located in a range of three inches to four inches below the actuator mechanism.

4. The aerosol dispenser of claim 2 including a dip tube having a length greater than the upper portion and extending from the valve assemble to a bottom location in the container adjacent to the straight cylindrical wall.

5. The aerosol dispenser of claim 1 wherein the plurality of annular surfaces include a first plurality of wide recesses in the upper portion of the cylindrical side wall and a second plurality of narrow recesses in a transition region extending between the wide recesses and a straight walled lower portion of the cylindrical side wall.

6. The aerosol dispenser of claim 5 wherein the first plurality of wide recesses comprise at least three recesses alternately arranged with raised ridges located therebetween, and the second plurality of recesses comprise at least two narrow recesses positioned in the transition region.

7. The aerosol dispenser of claim 1 wherein the plurality of annular surfaces includes a first plurality of wide recesses in the cylindrical wall and at least one transition recess, said transition recess being spaced farther from the valve assembly than the first plurality of wide recesses and being depressed less than the first plurality of wide recesses.

8. The aerosol dispenser of claim 1 including a spray dome having snap-fit ridges secured to a bead between the top wall and the side wall, and the actuator mechanism comprises a movable trigger located above the valve assembly and having a rear hinge connected to the spray dome so that depression of the trigger will activate the valve assembly.

9. The aerosol dispenser of claim 1 wherein the uppermost of the plurality of annular surfaces are located in a range from 1.5 inches to 2.5 inches below the actuator mechanism.

10. An aerosol dispenser comprising:

a pressurized container of generally cylindrical shape having a wavy upper section formed by an undulating side wall and a smooth lower section formed by a straight side wall, a bottom wall sealed to the smooth lower section of the container and capable of withstanding a mixture under pressure, a valve assembly sealed to the upper section of the container and capable of withstanding a mixture under pressure, including an actuator for opening the valve assembly to create an aerosol spray, the undulating side wall being formed by a plurality of annular surfaces surrounding the upper section and having a width and depth to receive fingers and/or a thumb of a user's hand to create an ergonomic grip for the user's hand.

11. The aerosol dispenser of claim 10 wherein at least one of the annular surfaces is spaced in a range from two inches to four inches from the actuator.

12. The aerosol dispenser of claim 10 wherein the container is metal of thin rectangular shape which is formed into a cylindrical shape and closed along an elongated seam which extends the length of the upper and lower sections to thereby seal the container.

13. The aerosol dispenser of claim 12 wherein the metal is steel on the order of 0.007 inches to 0.009 inches in thickness.

14. The aerosol dispenser of claim 12 wherein the plurality of annular surfaces include a series of concave annular recesses located in the wavy upper section of the metal side wall.

15. The aerosol dispenser of claim 10 wherein the plurality of annular surfaces comprise a first plurality of wide recesses formed in the metal side wall and a second plurality of narrow recesses formed in the metal side wall to form a transition section between the wide recesses and the straight side wall forming the smooth lower section.

16. The aerosol dispenser of claim 10 including a spray dome having snap-fit connection to an end portion of the upper section of the container, the spray dome including a movable trigger which depresses the actuator in order to open the valve assembly.

17. The aerosol dispenser of claim 16 wherein the spray dome is formed of plastic and has an opening aligned with the valve assembly for allowing the aerosol spray to pass through the spray dome.

18. The aerosol dispenser of claim 10 wherein the plurality of annular surfaces comprise concave recesses which extend inwardly from a cylindrical plane of the smooth lower section.

19. The aerosol dispenser of claim 10 wherein the plurality of annular surfaces comprise convex bulges which extend outwardly from a cylindrical plane of the smooth lower section.

* * * * *